United States Patent [19]

Schrecker

[11] 4,210,259

[45] Jul. 1, 1980

[54] BARRIER COATED METALLIC CONTAINER WALL AND SHEET

[75] Inventor: H. Dale Schrecker, Leechburg, Pa.

[73] Assignee: Aluminum Company of America, Pittsburgh, Pa.

[21] Appl. No.: 913,938

[22] Filed: Jun. 8, 1978

[51] Int. Cl.[2] ..... B65D 7/04

[52] U.S. Cl. ..... 220/455; 220/66; 220/456; 220/458; 428/35; 428/327; 428/418; 428/457

[58] Field of Search ..... 428/35, 418, 327, 339, 428/340, 407, 462, 413, 457, 461; 72/46, 42; 220/64, 277, DIG. 1, DIG. 14, 67, 66, 458, 455, 457; 113/121 R, 121 C, 121 B, 120 A, 120 XY; 106/288 Q

[56] References Cited

U.S. PATENT DOCUMENTS

| | | | |
|---|---|---|---|
| 3,294,568 | 12/1966 | Gossman | 428/327 |
| 3,478,554 | 11/1969 | Dempsey et al. | 72/46 |
| 3,958,064 | 5/1976 | Brekken et al. | 428/900 |

*Primary Examiner*—Stanley S. Silverman

*Attorney, Agent, or Firm*—Patrick J. Viccaro

[57] ABSTRACT

A metal container end wall is provided with a barrier-lubricant coating having a hard thermosetting resinuous base, preferably epoxy, and a particulate additive, preferably polyethylene or synthetic wax, on the external surface of the end wall to substantially eliminate metal fines and slivers caused by severing the end wall from a container with a conventional can opener.

A barrier coated metal sheet is also provided.

5 Claims, 1 Drawing Figure

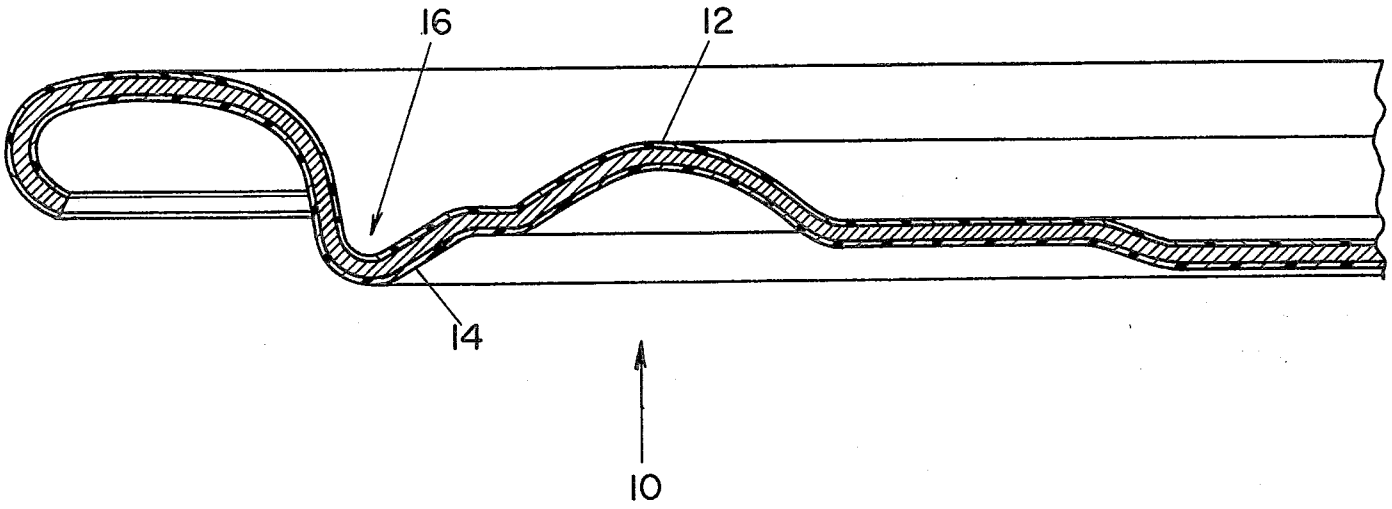
12
16
14
10

BARRIER COATED METALLIC CONTAINER WALL AND SHEET

BACKGROUND OF THE INVENTION

This invention generally relates to providing a resinous coating on metal sheet and a metallic container wall. In addition, and more particularly, it relates to a metallic container wall having on its external surface an epoxy coating containing a lubricant. The coating substantially eliminates metallic slivers and metal fines caused by severing the end wall with a conventional plow-type can opener.

For many cans not having easy opening devices, it is necessary to open them by conventional mechanical can openers. Most can openers, whether manually or electrically operated, include a cutting edge for severing the container end wall and gears for engaging the seam of the container end to rotate the container with respect to the cutter. When opening a container, a can opener usually contacts a container end wall at several places in addition to the line of severance. One problem with conventional can openers is the likelihood of producing slivers and metal fines resulting from the severing of the end panel. Such slivers and metal fines are the direct result of the friction and abrasion on the metallic surface of the container by the cutting edge and other contact areas of the can opener. The small metal particles can fall into the container and be deleterious to its contents, such as food stuffs, during the cutting operation or during the removal of the end panel.

Slivering generally becomes more of a problem when container end panels are made of aluminum or its alloys. Generally, aluminum and its alloys exhibit a coefficient of surface friction relatively higher than other metals. Aluminum end panels tend to offer a greater sliding friction with the contacting point of a can opener than, for example, steel or tinplate container end panels. The higher frictional resistance tends to cause more slivers and metal fines than such non-aluminum end panels.

Additionally, container opening techniques can vary between individuals. It has been found that the force applied by individuals to can openers, especially to manually operated openers, affects the degree of slivering of container end panels, regardless of the metal of the panels. The amount of friction depends in part on the force applied.

Another variable affecting the slivering problem is the inherent tolerances between each can opener, even those made by the same manufacturer. As can openers vary, the number of contact places and the force of contact with a container end panel will vary resulting in varying degrees of slivering.

To solve the slivering problem, particularly of aluminum ends, a solution which overcomes or eliminates the problem variables is required. Ideally, opening an aluminum container end panel without slivers and metal fines should be independent of the can opener used and any individual techniques of opening.

Various approaches have been taken in the prior art to deal with problems relating to the opening of metal container ends using can openers. In general, the approaches involve relocating the severance of the end panel to an outer surface of the double seam joining the panel to the container body. U.S. Pat. No. 2,384,042, issued Sept. 4, 1945, discloses a closure being removed by cutting the seam on the lower side and outside of the container wall so that metal particles do not fall into the container when the closure is removed. U.S. Pat. No. 2,311,001, issued Feb. 16, 1943, also relates to severing outside the seam and uses a sealing compound within the folds of the container double seam. The raw edge of the container body is embedded in the sealing compound where the cutting occurs. A specifically designed can opener and container end seam construction are discussed in U.S. Pat. No. 3,139,211, issued June 30, 1964, for the purpose of avoiding penetration and thus contamination of the interior of the can by the can opener, the can cover or any operation associated with the opening procedure.

It has also been proposed that slivering of aluminum container ends can be substantially eliminated by, singly or in combination, modifying the profiles of end panels, changing alloy composition of end panels and modifying conventional can openers. End profiles have been changed to include recesses about the panel periphery where severance occurs. Also, score lines have been used at the line of severance to reduce metal thickness. Various aluminum alloys were tried and some were found to reduce the slivering problem of container ends made of those alloys. Modified conventional can openers with smaller controlled tolerances and a reduced angle of the cutting edge of the opener plow face have also minimized slivering. While these proposed approaches can be somewhat successful in minimizing slivering, they can be impractical and uneconomical for the can industry to implement. Other more practical solutions to the slivering problem are needed.

It is also known to coat can sheet on one or both surfaces with a thermoplastic material prior to blanking can ends from the sheet, as is shown in U.S. Pat. No. 2,086,165 issued July 6, 1937. A metallic container wall may also be provided with a laminate on its interior surface that withstands scoring without fracturing entirely therethrough, as is shown in U.S. Pat. No. 3,632,461 issued Jan. 4, 1972. As barrier layer of polyethylene may be secured to the container wall by an epoxy adhesive and an outer protective layer of polyethylene may be secured to the barrier layer by an adhesive of epoxy to protect the container wall from the contents of the container, and vice versa.

Applying a coating containing a lubricant to metal before working, such as by drawing and shaping, is also known in the art. Coating a metal with a lubricant consisting essentially of a solid high molecular weight polymer such as polyethylene, having a long carbon chain, is shown in U.S. Pat. No. 3,250,103 issued May 10, 1966. The polypropylene may be used alone or modified with a wax. A lubricant formed by a dispersion of cellulose ethers with one or more of other ingredients, such as polyethylene, is disclosed in British Pat. No. 1,004,836. U.S. Pat. No. 3,478,554, issued Nov. 18, 1969 and assigned to the common assignee of the present invention, discloses a method of drawing metal sheet having a resinous coating containing a lubricant. The resinous coating of that patent may be of the epoxy type containing a lubricant, such as polyethylene, which is from 2 to 6% by solid weight of the coating.

Even though it is known for metal containers to have thin exterior coatings to improve handling of the container and/or its aesthetic appearance, and to protect a container from its environment, there still exists a need in the prior art for substantially eliminating slivers and metal fines caused by the use of conventional can openers on metallic can ends such as those made of aluminum. The problem solution should be independent of alloy compositions, profiles of the end panels, individual can opening techniques and the can opener used. It is desirable that a container end wall be provided which is economically compatible with conventional can making, which has improved opening characteristics and for which no special or non-conventional can opener is needed.

SUMMARY OF THE INVENTION

In accordance with this invention, a metallic container end is provided with an external protective coating of a hard thermosetting resin and 20 to 30% by solid weight particulate additive. The coating is hard and abrasion resistant and acts as a physical barrier-lubricant to reduce friction at places of contact between the conventional can opener and the metallic container end wall. The ease of formulation and application of the coating makes it compatible with conventional can making. A metal end wall is provided which is severable from a container by a can opening device. A metal sheet is provided having a protective barrier coating on the surface thereof which will be the exterior surface of a container end wall formed therefrom. The coating may have a minimum coating weight of 4 mg/in$^2$.

BRIEF DESCRIPTION OF THE DRAWING

The sole FIGURE is a fragmentary cross-sectional view of a container wall of the present invention.

DETAILED DESCRIPTION OF THE PREFERRED EMBODIMENTS OF THE INVENTION

Generally, a metallic container end wall of the present invention is a coated container end which is attachable to a container body by a seam and which can be opened by a conventional can opener. The container end is a metal sheet externally coated with a material which acts as a physical barrier between the cutting edge and other parts of the can opener and the metal end.

The FIGURE illustrates a fragmentary cross-sectional view of a container end wall of the present invention before attachment by a double seam to a container. End panel 10 is a formed metal sheet having coating 12 on the surface to be exposed to the container exterior. Coating 12 eliminates slivers and metal fines when panel 10 is attached to a container and severed by a can opener at recess 16. Though shown in the FIGURE, the preferred recess 16 is not necessary to the present invention. Any of many available conventional laminates 14 may be on the interior exposed surface of panel 10 to protect the container from its contents and to protect the contents of the container from reaction with the metal.

Coating 12 may be applied to the entire external surface of the container end wall or it may be selectively applied to the region radially inward from the seam at the location where the cutting tool of the opener severs the end panel. When so applied, only any slivering caused by the cutting edge is eliminated. Alternately, all of the regions contacted by other parts of the opener may be coated in addition to the region of cutting tool severance. As a matter of convenience and so that the coating of the present invention can be incorporated into existing can making lines, preferably, entire metal sheets or rolls can be coated prior to blanking and forming into the metal can ends. Coating 12 acts as a physical barrier between the bare metal of the container end wall and the contacting portions of the opener. Such a physical barrier reduces the high coefficient of friction of the metal container end and thus substantially eliminates the abrasion of the metal surface by the contacting and cutting edges of the opener. In the absence of such a barrier coating, the cutting edge and other contact areas of the can opener would remove surface metal of the end wall and produce metal fines and slivers.

It has been found that a coating having a hard finish and relatively high abrasion resistance provides the physical barrier necessary to substantially eliminate metal fines and slivers. A thermoplastic material, particularly a resinous material of the thermosetting type, preferably a hard thermosetting epoxy, tends to provide satisfactory results. Numerous epoxies are commonly available in liquid form and may be of the clear type or color tinted. A hard thermosetting epoxy sold under the trademark Mobil S-8988 is preferred for it tends to provide the best results. A catalyst or hardening agent may be added to the epoxy to promote curing and improve the hardness and abrasion resistance of the coating 12.

Even better results can be obtained by mixing a particulate additive to a hard thermosetting resin base for providing a physical barrier coating of the present invention. Coating 12 generally comprises a resinous base containing a substantial portion of an additive in particulate form. The additive acts as a lubricant and may be contained in the resin base in amounts of 20 to 30% by weight of the coating. As used herein, the weight percentages are on the basis of solids contained in coating 12 as cured on a container end or metal sheet. Preferably, coating 12 comprises a resin base of hard thermosetting epoxy and 20 to 30% of a particulate lubricating additive.

The particulate additive for the resinous base provides lubricity to coating 12 and acts as a physical barrier between a can opener and the container end panel. Particulates of natural or synthetic materials have been satisfactorily used, and combinations thereof may be likewise used. The particulates may have a size ranging from 5 to 50 microns and, preferably, the average size of particulate is less than 20 microns. Particulates of lubricating additive may be present in amounts of 20 to 30% by solid weight of the coating and are uniformly dispersed in a mechanical suspension in the liquid resin base. Generally, the liquid coating mixture of lubricating additive and resin base need constant agitation to maintain a uniform dispersion of particulates in the coating mixture before applying the coating to metal can stock. Though several additive materials have been used with varying degrees of satisfactory performance, it has been found that powdered or particulate polyethylene and synthetic waxes provide the best results.

Preferred amounts of polyethylene range from 23 to 27% by solid weight. Lower weight percentages of polyethylene have proven less effective in that they have not provided the sufficient lubrication necessary to overcome the friction between a can opener and the metal end. The addition of more than 27% polyethylene does not significantly increase the abrasion resistance while making the coating heavier. When the coating becomes too heavy, there may be a crumbling or chipping of the coating from the metal end during severance of the metal by a can opener and a tendency for the coating to build up on the cutting edge of the can opener. Polyethylene is available as a powder and can be mixed with the resin base to form a suspension-type mixture of polyethylene particles in a resinous base. Though various polyethylenes may be useful within the scope of this invention, it is preferred to use a low density polyethylene powder sold under the trademark Microthene FN510 by U.S.I. Chemical Company.

Synthetic and natural waxes are available in a powder form and when mixed with a resinous base provide a suspension-type mixture of wax particles in the resin. The wax may be from 20 to 30% by solid weight of the coating. As with the polyethylene, too little or too much wax by weight provides, respectively, insufficient lubricity or crumbling. Synthetic waxes which have provided satisfactory results are a powder sold under the trademark Acrawax by Glyco Chemicals, Inc., and nylon powder. Carnauba wax is a natural wax which indicates a tendency to provide satisfactory results.

With some workable coatings of the present invention, it may be necessary to include in the coating an element to mask "blushing" of the coating. Small percentages of titanium dioxide ($TiO_2$) may be added for that reason with the clear epoxy-polyethylene coating. $TiO_2$ is useful to mask the "blushing" of the coating that may result from retorting the filled container. Generally, blushing can be defined as the absorption of moisture by the coating which causes a change in the light reflectivity of the coating giving it a grayish or whitish cast. Titanium dioxide is a commonly available compound which is a white pigment and is used primarily to give a white appearance to coatings. The effect of using titanium dioxide is to pre-blush the coating on the metal end to a predetermined color such that there will not be any further color change during retorting or other processing. As little as 1% titanium dioxide changes the color of the epoxy polyethylene coating from clear to opaque. In the practice of this invention, the solids weight percentage of titanium dioxide may range from 0 to 10%, and preferably ranges from 7 to 10%.

In addition, it may be necessary for some mixtures of resins and lubricating additives, to use a suitable catalyst as a hardening agent to promote curing of the resinous base of the coating. Suitable catalysts found are sold under the trademark of Mobil S-6827-011 and Mobil S-8709-003. A suitable solvent may also be used in the dispersion of lubricating additive in resin to provide a viscosity that facilitates application of the coating.

Coating material for use in the practice of this invention may be made by adding lubricating powder to liquid resinous material. The mixture can be made at room temperature and there must be a good dispersion of powder in the resinous base. Mixing may include preparing a slurry of additive particulate to facilitate wetting of the particulate before combining the additive with the liquid resin base. The coating can be mixed using conventional methods and techniques and then may be applied to metal sheet at room temperature using methods known in the art.

It is preferred that a mixture of resin and particulates of lubricating additive, and any blushing mask, solvent, hardening agent, or catalyst be applied to can end stock sheet prior to blanking and forming can ends. The coating is applied at a minimum coating weight of 4 mg/in$^2$ (6.2 g/m$^2$) up to a weight of 6 mg/in$^2$ (9.3 g/m$^2$). It is preferred that a coating weight of about 4-½ to 5-½ mg/in$^2$ (7.0 to 8.5 g/m$^2$) be used. After the coating is applied, the coating is cured. The coating of the present invention should not be undercured. An undercured coating may not harden sufficiently to provide the cohesive hardness necessary to provide an abrasive resistant coating. In addition, an undercured coating may not adhere to the metal end and may peel.

During curing of the coating containing a resin base and particulate additive, as the resin hardens it is believed that the lubricating additive "blooms" to the surface of the coating resulting in a cured coating with the additive near the coating surface. As used herein, "blooms" means that the additive particulates, which were generally uniformly dispersed in the liquid coating, move closer to the exposed surface of the coating away from the metal surface to which the coating adheres.

In order to more completely understand the present invention, the following examples, are presented:

EXAMPLES

The coatings of the present invention shown in the following Table I are made by mixing particulate additive with a liquid resin base at room temperature to form a uniformly dispersed suspension of particles. The average particulate size is less than 20 microns in size. Some coatings include catalysts as identified in the tables. Each coating is roll coated on metal sheet at about 4½ mg/in$^2$ (7.0 g/m$^2$) and cured before blanking and forming metal container ends. The coating is cured at a temperature of the metal sheet of 375° to 425° F. (463.7° to 491.5° K.). After attachment to container bodies, the end panels are removed by conventional can openers. Strain gauges, attached to can opener handles, provide a means of determining relative degrees of force between the minimum and maximum needed to open the container with a can opener without slivers or metal fines and thus provide a qualitative means to measure the degree of success of the coating of the present invention.

TABLE I

| | Strain Indicator Reading | | | |
|---|---|---|---|---|
| Coating | Min. Force to Open | 2 | 3 (Approx. Ave. Force) | 4 |
| S-8988 epoxy + 25% Microthene polyethylene | A | A | A | A |
| S-8988 epoxy + 25% nylon | A | A | A | B |
| S-8988 epoxy + 20% Acrawax | A | A | B | B |
| S-8988 epoxy + 0.5% S-6827-001 catalyst | A | A | B | C |
| S-8988 epoxy + 20% carnauba wax | A | B | D | E |
| S-8988 epoxy | C | C | D | E |

Table I demonstrates the outstanding success of the coating of the present invention to facilitate substantially sliver-free opening of metal containers with conventional can openers over a range of opening forces. Strain indicator reading "3" approximates an average or normal force exerted by individuals in opening a can. Reading "4" indicates a greater force, while column 1 indicates the opening success under light loads, i.e. at a minimum force needed to open the metal can. The following rating scale was used to judge the opening success of each coating: "A" for excellent, "B" for acceptable, "C" for borderline, "D" for poor and "E" for very poor. The resin base of the coating in the table is a hard thermosetting epoxy by Mobil Oil Company.

TABLE II

| Coating | Strain Indicator Reading Min. Force to Open | 2 | 3 | 4 |
|---|---|---|---|---|
| S-8988 epoxy + 25% silica aerogel | D | E | | |
| S-8988 epoxy + 25% propylene polymer | D | E | | |
| S-8988 epoxy + 25% Teflon powder | D | E | | |
| S-5061 gold epoxy | D | E | | |
| V-1161 epoxy | D | E | | |
| X-1174-CL epoxy | D | E | | |
| S-9045-002 polyester | D | E | | |
| S-9045-002 polyester + 0.5% S-9021-003 catalyst | E | | | |
| S-3208-005 vinyl | D | E | | |
| S-8528-002 acrylic | D | E | | |

Table II is illustrative of some other coatings tried which did not solve the slivering problem. All of the coatings in the table resulted in slivers and metal fines even when a minimum force was used to open the coated container end wall. All the coating elements identified by the letter "S" are Mobil products, while "V" indicates a Midland Industrial Finishes Company product and "X" a product by Celanese Chemical Company. The same rating scale and strain gauge readings were used for the container ends with the Table II coatings.

From the tables it is demonstrated that the coating of the present invention solves the slivering problem in a desirable manner. The coated metal ends and sheet are abrasion resistant and are compatible with conventional can manufacturing processes. The coating of the present invention also provides an economical solution to the slivering problem. There is no need to modify can openers or can end profiles. Individual can opening techniques are less a factor causing slivering because of the wider range of forces within which the coating operates well.

Before making the coating of the present invention, numerous polyester acrylic, vinyl and epoxy coatings plus catalysts and synthetic waxes had been tried, as well as some of the conventional coatings currently being used by can makers as standard rigid container sheet coatings. None of the mixtures had the abrasive resistance, ease of formulation, or compatibility with conventional processing of the coating of the present invention.

Although embodiments have been described, it will be apparent to those skilled in the art that changes can be made therein without departing from the scope of the invention.

What is claimed is:

1. In a container having a metal end wall attached to the container body by a seam and severable therefrom by a mechanical can opening device, said end wall comprising:

a formed metal sheet; and a protective, hard, abrasion resistant barrier coating, including a hard thermosetting epoxy resin and 20 up to 30% by weight particulate additive, on the exterior of said container end wall in the region where the end is to be severed by a can opening device to reduce friction between the end wall and the opening device to substantially eliminate metal slivers caused by the severance;

said particulate additive containing at least one material selected from the group consisting of polyethylene, synthetic wax and natural wax and having an average particle size of less than 20 microns.

2. The container end wall as set forth in claim 1 wherein the synthetic wax includes nylon.

3. The container end wall as set forth in claim 1 wherein when said barrier coating includes particulate polyethylene it further includes up to 10% titanium dioxide.

4. The container end wall as set forth in claim 1 wherein the barrier coating has a minimum coating weight of 4 mg/in$^2$.

5. In a container having a metal end wall attached to the container body by a seam and severable therefrom by a mechanical can opening device, said end wall comprising:

a formed aluminum sheet; and a hard, protective, abrasion resistant barrier coating on the exterior of said container end wall in the region where the end is to be severed by a can opening device to reduce friction between the end wall and the opening device;

said coating including 20 up to 30% by weight a particulate additive containing at least one material selected from the group consisting of polyethylene, nylon and carnauba wax in a hard thermosetting resinous epoxy base and having an average particle size of less than 20 microns.

* * * * *